US009291023B2

(12) United States Patent
McGilvray, Jr. et al.

(10) Patent No.: US 9,291,023 B2
(45) Date of Patent: Mar. 22, 2016

(54) STEM HEAD ADAPTER WITH PISTONS

(71) Applicant: GE Oil & Gas Pressure Control LP, Houston, TX (US)

(72) Inventors: Mark Anthony McGilvray, Jr., Houston, TX (US); Alfred Olvera, Houston, TX (US); Gajanan B. Hegde, Houston, TX (US); Keith M. Adams, Houston, TX (US)

(73) Assignee: GE Oil & Gas Pressure Control LP, Houston, TX (US)

( * ) Notice: Subject to any disclaimer, the term of this patent is extended or adjusted under 35 U.S.C. 154(b) by 0 days.

(21) Appl. No.: 14/528,376

(22) Filed: Oct. 30, 2014

(65) Prior Publication Data

US 2015/0114661 A1 Apr. 30, 2015

Related U.S. Application Data

(60) Provisional application No. 61/898,106, filed on Oct. 31, 2013.

(51) Int. Cl.
*E21B 33/035* (2006.01)
*E21B 33/043* (2006.01)
*E21B 33/04* (2006.01)

(52) U.S. Cl.
CPC ..... *E21B 33/0415* (2013.01); *E21B 33/04* (2013.01)

(58) Field of Classification Search
CPC ... E21B 33/035; E21B 33/04; E21B 33/0415; E21B 33/043
USPC ..... 166/358, 339, 345, 348, 368, 378, 85.1, 166/367
See application file for complete search history.

(56) References Cited

U.S. PATENT DOCUMENTS

| | | | | |
|---|---|---|---|---|
| 2,293,012 | A * | 8/1942 | Barker | 285/96 |
| 3,380,519 | A * | 4/1968 | Fowler | 166/335 |
| 3,984,990 | A * | 10/1976 | Jones | 405/224.2 |
| 6,401,827 | B1 | 6/2002 | Ferguson et al. | |
| 6,918,446 | B2 | 7/2005 | Borak, Jr. | |
| 2004/0163821 | A1 | 8/2004 | vanBilderbeek | |
| 2011/0192611 | A1 * | 8/2011 | Fraser et al. | 166/345 |

OTHER PUBLICATIONS

International Search Report and Written Opinion issued in connection with corresponding PCT Application No. PCT/US2014/063346 dated Jul. 28, 2015.

* cited by examiner

*Primary Examiner* — James G Sayre
(74) *Attorney, Agent, or Firm* — Bracewell LLP

(57) ABSTRACT

A casing head assembly for landing on a stem head of a floating structure can include a stem head adapter assembly that includes a ring shaped stem head adapter plate. A solid upper ring is spaced axially above the stem head adapter plate, defining an adapter gap between the upper ring and the stem head adapter plate. At least one load cell can have a first end that is supported by the stem head adapter plate and a second end that engages the upper ring. At least one piston assembly is selectively secured to the upper ring. The casing head assembly also includes a casing head landed on, and secured to, the upper ring of the stem head adapter assembly. The load cell is selectively constrained between the upper ring and the stem head adapter plate by a load on the casing head.

19 Claims, 5 Drawing Sheets

STEM HEAD ADAPTER WITH PISTONS

CROSS REFERENCE TO RELATED APPLICATION

This application claims priority to and the benefit of U.S. Provisional Application Ser. No. 61/898,106 filed Oct. 31, 2013, titled "Stem Head Adapter with Pistons," the full disclosure of which is hereby incorporated herein by reference in its entirety for all purposes.

BACKGROUND

1. Field of Invention

This invention relates in general to wellhead assemblies used in the hydrocarbon industry, and in particular to stem head assemblies of wellhead assemblies on floating platforms or rigs.

2. Description of Prior Art

Some floating structures used for hydrocarbon development have riser strings for conveying produced fluids from a sea floor based wellhead system to a surface wellhead located at the floating structure. The riser string can be supported by a riser support system that includes a stem head located at the floating structure. Near the top of the riser can be a casing head that lands in the upper ring at an upper end of the stem head so that the riser is supported at its top end by the floating structure. Load cells can be added between the casing head and stem head that measure the tension load or weight of the riser string on the stem head and joint.

In some current systems, in order to replace the load cells, the casing head is tipped to one side in order to release one load cell at a time.

SUMMARY OF THE DISCLOSURE

Embodiments of the current disclosure provide systems and methods for simultaneously removing multiple load cells that are part of a casing and stem head assembly. By lifting the casing head axially, no pinch points are formed that could cause safety concerns. In addition, piston assemblies that are part of embodiments of this disclosure can be removed and replaced without lifting the casing head in order to do so. Systems and methods of this disclosure also provide a rigid stem head adapter assembly that is able to support significant casing head load.

In an embodiment of this disclosure, a casing head assembly for landing on a stem head of a floating structure can include a stem head adapter assembly. The stem head adapter assembly has a stem head adapter plate. The stem head adapter plate is a ring shaped member. An upper ring is spaced axially above the stem head adapter plate, defining an adapter gap between the upper ring and the stem head adapter plate. The upper ring is a solid ring shaped member. At least one load cell can have a first end that is supported by the stem head adapter plate and a second end that engages the upper ring. At least one piston assembly is selectively secured to the upper ring. The casing head assembly also includes a casing head landed on, and secured to, the upper ring of the stem head adapter assembly. The load cell is selectively constrained between the upper ring and the stem head adapter plate by a load of the casing head.

In an alternate embodiment of this disclosure, a casing head assembly for landing on a stem head of a floating structure includes a stem head adapter. The stem head adapter has a stem head adapter plate that is ring shaped and has an upward facing upper mating surface and an opposite facing lower mating surface. An upper ring is spaced axially above the stem head adapter plate, defining an adapter gap between the upper mating surface and the upper ring. The upper ring is a ring shaped solid member. A plurality of load cells each have a first end that is supported by the upper mating surface and a second end that engages the upper ring. A casing head is landed on, and secured to, the upper ring of the stem head adapter assembly. The lower mating surface is selectively landed on, and secured to, the stem head. The stem head adapter assembly also includes a plurality of piston assemblies spaced around the upper mating surface. A portion of each of the piston assemblies is located in the adapter gap. Selectively operating the piston assemblies moves the upper ring upward from the adapter plate to enable the load cell to be removed for repair or replacement.

In yet another alternate embodiment of this disclosure, a method for supporting a casing head assembly on a stem head of a floating structure includes providing a stem head adapter assembly. The stem head adapter assembly has a stem head adapter assembly including a stem head adapter plate and a solid ring shaped upper ring spaced axially above the stem head adapter plate defining an adapter gap between the upper ring and the stem head adapter plate. The stem head adapter assembly also includes a plurality of load cells with a first end that is supported by the stem head adapter plate and a second end that engages the upper ring. A plurality of piston assemblies are each selectively secured to the upper ring. A casing head is landed on the upper ring of the stem head adapter assembly and the stem head adapter plate is landed on an upper end of the stem head. A load of the casing head is supported and measured with the load cells.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE DISCLOSURE

Figure 1:
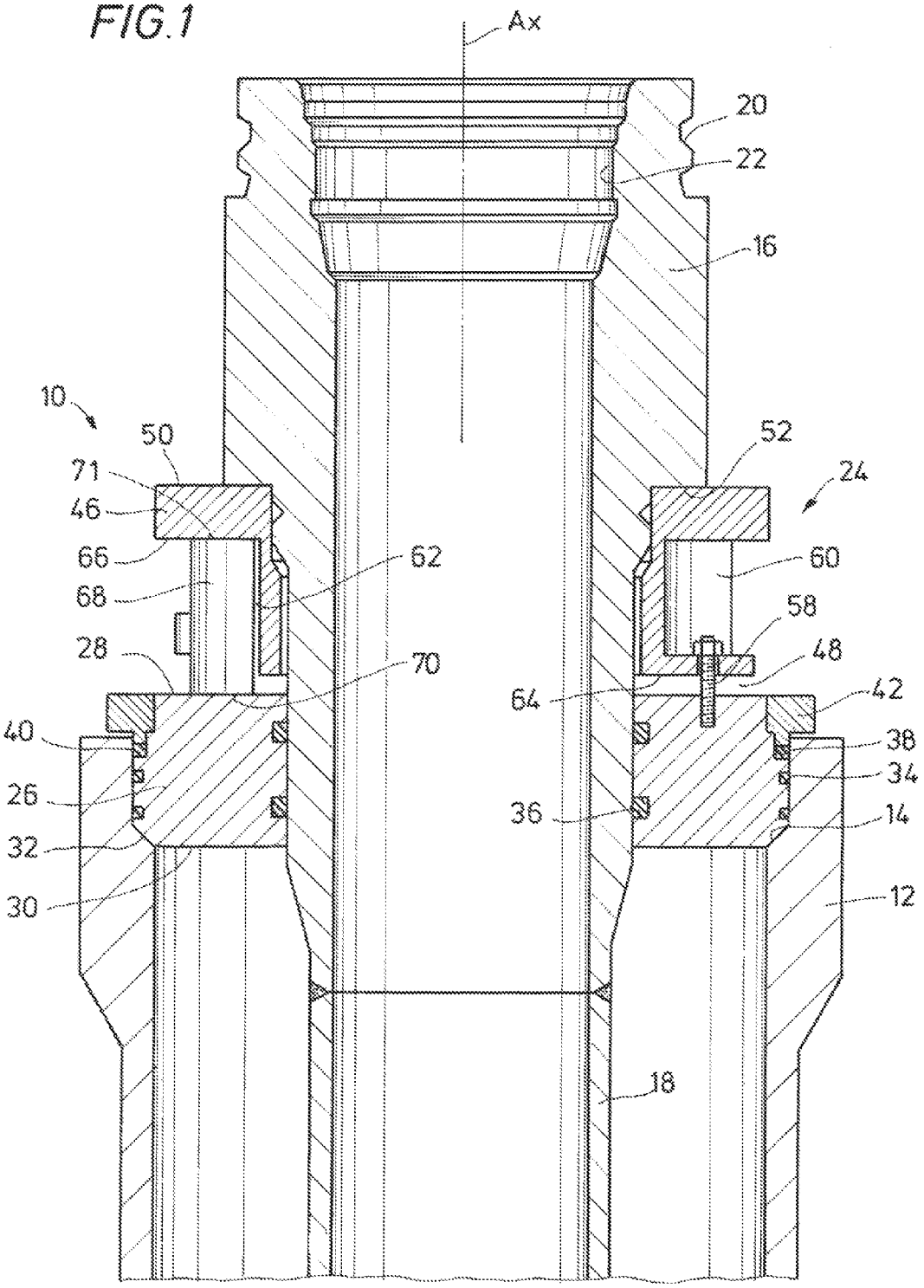
FIG. 1 is a sectional elevation view of a casing head assembly landed on a stem head, including a stem head adapter assembly in accordance with an embodiment of this disclosure.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, casing head assembly 10 is shown landed on stem head 12. Stem head 12 can be a tubular structure centered around central axis Ax and that is supported on a floating structure (not shown) that is associated with a subsea hydrocarbon well. Stem head 12 has a landing profile 14 for accepting casing head assembly 10. In the example of FIG. 1, landing profile 14 is an annular and generally upward facing sloped surface on an inner diameter of stem head 12.

Figure 2:
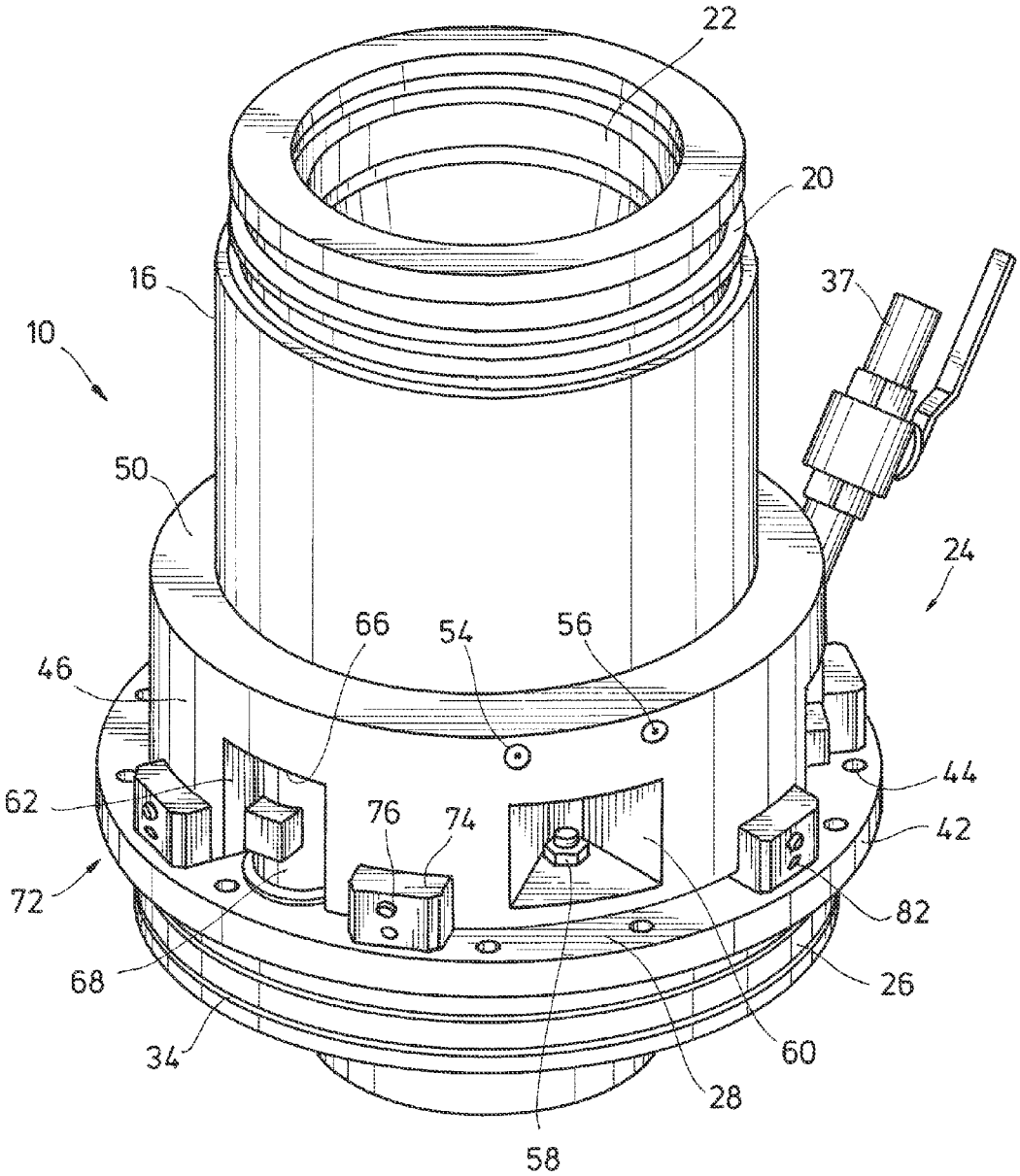
FIG. 2 is a perspective view of a stem head adapter assembly in accordance with an embodiment of this disclosure, secured to a casing head.
Figure 3:
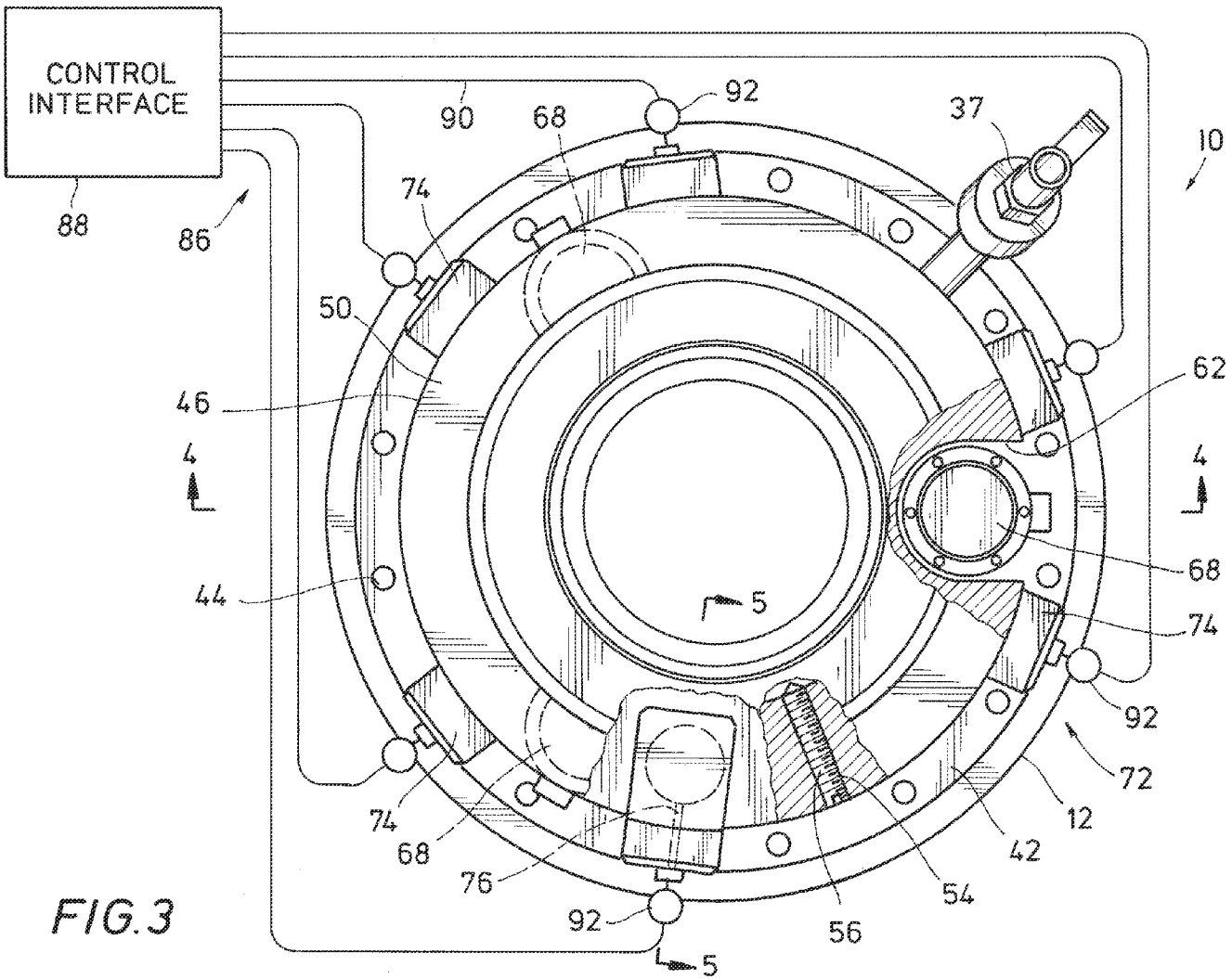
FIG. 3 is a cross sectional plan view of the stem head adapter assembly and casing head of FIG. 1.
Figure 4:
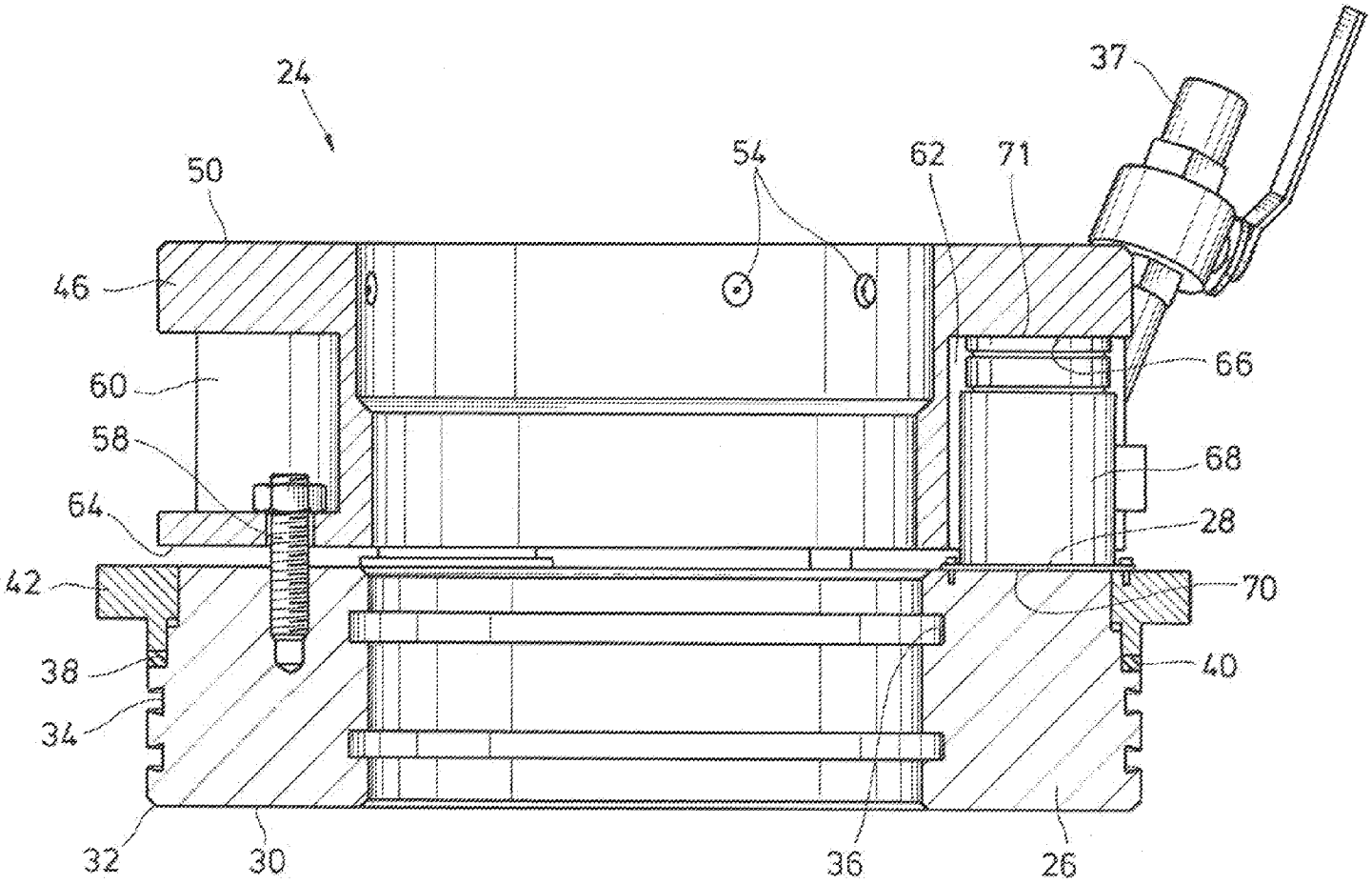
FIG. 4 is a sectional elevation view of only the stem head adapter assembly of FIG. 1, shown along line 4-4 of FIG. 3.

Looking at FIGS. 1-3, casing head assembly 10 can include casing head 16. Casing head 16 is a tubular member with an inner bore that is concentric with casing head 16 and centered around central axis Ax. Casing head stem joint 18 is secured to a lower end of casing head 16, for example, by being welded to casing head 16. A riser string (not shown) can be located at a lower end of casing head stem joint 18, the riser string extending downward to a subsea wellhead system (not shown). An upper end of casing head 16 can include an exterior profile 20 on an outer diameter surface of casing head 16, and an inner profile 22 on an interior surface of the bore through casing head 16. Exterior and interior profiles 20, 22 can include thread, parallel grooves, diameter variations, an NT-2 style connection, or other profile known in the art. Exterior and interior profiles 20, 22 can be used to mate casing head 16 to, as an example, various tools, a blowout preventer, and other wellhead assembly components.

Looking now at FIGS. 1-5, casing head assembly 10 further includes stem head adapter assembly 24. Stem head adapter assembly 24 is located axially between stem head 12 and casing head 16 and supports the weight and load of casing head 16 on stem head 12. Stem head adapter assembly 24 includes stem head adapter plate 26. Stem head adapter plate 26 is a ring shaped member. Stem head adapter plate 26 has an upward facing upper mating surface 28 and an opposite facing lower mating surface 30. When casing head assembly 10 is landed on stem head 12, lower mating surface 30 engages stem head 12. In the example embodiment shown in FIG. 1, outer shoulder 32 of lower mating surface 30 engages landing profile 14. Outer shoulder 32 has a shape that mates with landing profile 14 and can be, for example, a generally downward facing sloped surface.

An outer diameter of stem head adapter plate 26 sealingly engages an inner diameter of the bore of stem head 12. The outer diameter of stem head adapter plate 26 can have a number of circumferential external grooves 34 for housing outer sealing members. The outer sealing members will create a fluid seal between the outer diameter of stem head adapter plate 26 and an inner surface of the bore of stem head 12. Stem head adapter plate 26 can have internal grooves 36 on an inner diameter surface of the bore of stem head adapter plate 26. Internal grooves 36 can house inner sealing members. The inner sealing members will create a fluid seal between the inner diameter surface of the bore of stem head adapter plate 26 and an outer diameter surface of casing head 16. Ball valve assembly 37 (FIGS. 2-4) can provide access from an outside of stem head adapter plate 26 to the bore of stem head adapter plate 26.

Figure 5:
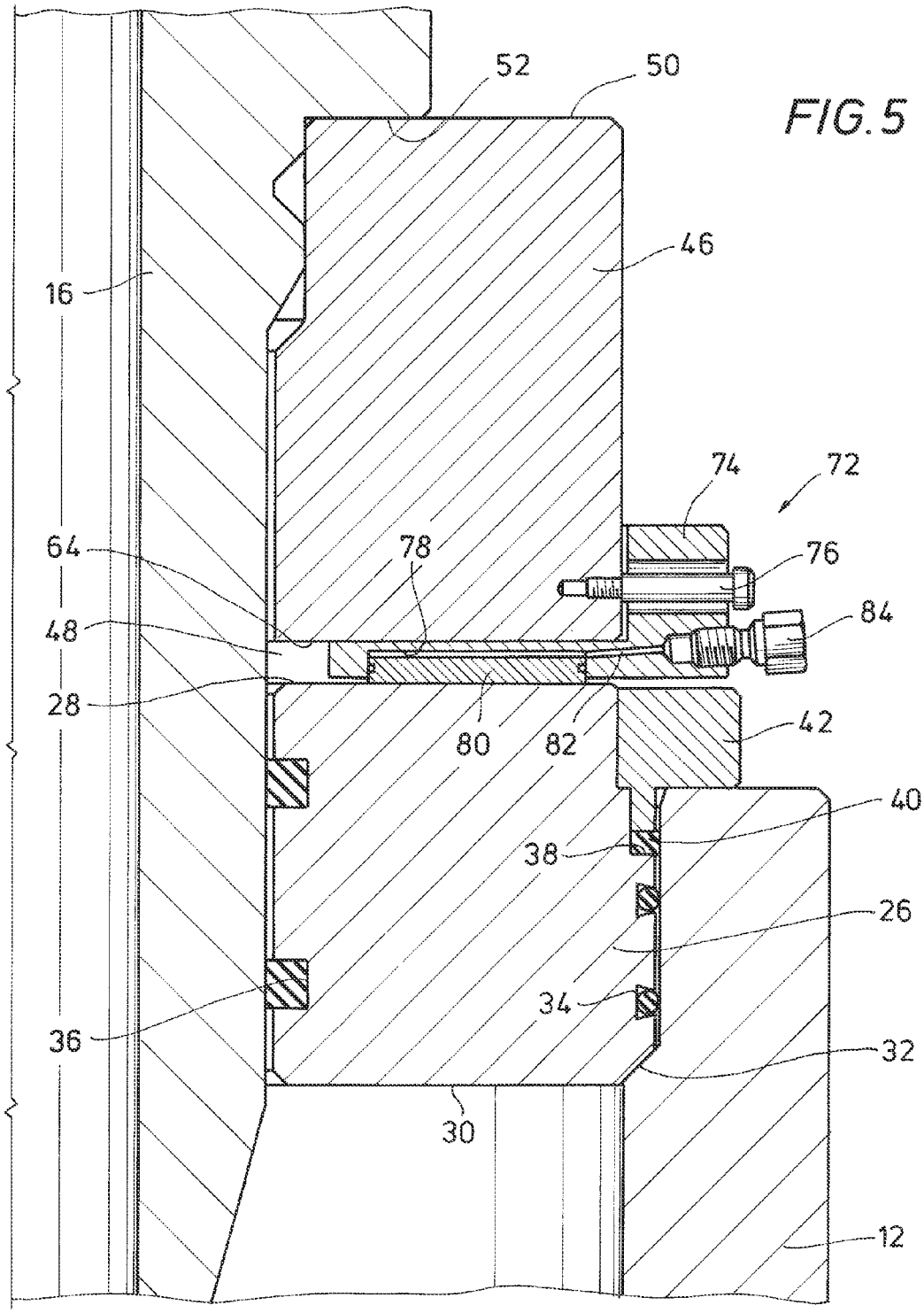
FIG. 5 is a sectional elevation view of a portion of the stem head adapter assembly of FIG. 1, shown along line 5-5 of FIG. 3, with a piston assembly in a contracted position.

Looking, for example, at FIG. 5, stem head adapter plate 26 can also include upward facing external lip 38. External lip 38 is an annular lip on the outer diameter of stem head adapter plate 26. Seal ring 40 can be located on external lip 38. Compression ring 42 can circumscribe stem head adapter plate 26. Compression ring 42 has a lower profile that engages and energizes seal ring 40 so that seal ring 40 can provide an additional seal between the outer diameter of stem head adapter plate 26 and an inner surface of the bore of stem head 12. Compression ring 42 can have holes 44 (FIG. 2) through which securing members (not shown) can extend to secure compression ring 42 to stem head 12. By securing compression ring 42 to stem head 12, compression ring 42 will move downward relative to stem head adapter plate 26 and compress seal ring 40 to energize seal ring 40. As compression ring 42 is secured to stem head 12, landing profile 14 limits axially downward movement of stem head adapter plate 26.

Continuing to look at FIG. 5 stem head adapter assembly 24 also includes an upper ring 46 that is spaced axially above stem head adapter plate 26, defining adapter gap 48 between upper ring 46 and upper mating surface 28 of stem head adapter plate 26. Upper ring 46 is a ring shaped solid member that has a bore with an inner diameter that is similar or equal to the inner diameter of the bore of stem head adapter plate 26.

Upper ring 46 includes upward facing upper load surface 50. Upper load surface 50 can be located at a top end of upper ring 46 and engages downward facing shoulder 52 (FIG. 1) of casing head 16. Casing head 16 is supported by upper load surface 50 of upper ring 46. Upper ring 46 can include radial holes 54 that extend radially through upper ring 46. Mounting members 56 can extend through radial holes 54 and into engagement with casing head 16, securing upper ring 46 and casing head 16 together.

Looking at FIGS. 1-2, connector members 58 can link upper ring 46 to stem head adapter plate 26. Connector members 58 link upper ring 46 to stem head adapter plate 26 in a manner that allows relative axial movement between upper ring 46 and stem head adapter plate 26 and prevents relative rotational movement between upper ring 46 and stem head adapter plate 26. In the example embodiments shown, connector members 58 can extend from lower cavity 60 of upper ring 46 and into stem head adapter plate 26. Upper ring 46 can include a number of lower cavities 60 spaced around the outer diameter of the upper ring. Each lower cavity 60 can open at the outer diameter of the upper ring and has a bottom surface for engaging connector member 58.

Upper ring 46 also includes at least one recess 62 spaced around the outer diameter surface of upper ring 46. Each recess 62 is open to the outer diameter surface of upper ring 46 and open at the bottom surface 64 of upper ring 46. Each recess 62 has a downward facing lower load surface 66. Lower load surface 66 can be located at an upper end of recess 62.

Stem head adapter assembly 24 further includes at least one load cell 68. A plurality of load cells 68 can be spaced around a circumference of stem head adapter plate 26. A load cell 68 can be located within each recess 62. In the example of FIG. 3, upper ring 46 has three recesses 62 and three load cells 68. In other embodiments, upper ring 46 can have more or less than three recesses 62 and stem head adapter assembly 24 can have more or less than three load cells 68. As an example, there may be two to six recesses 62 and two to six load cells 68.

Load cell 68 has a first end 70 that is supported by upper mating surface 28 of stem head adapter plate 26. A second end 71 of load cell 68 is opposite first end 70 and can engage lower load surface 66 of upper ring 46. Load cell 68 has an axial height that is greater than a distance between lower load surface 66 and bottom surface 64 of upper ring 46. This greater axial height of load cell 68 allows load cell 68 to support upper ring 46 at an axial elevation such that bottom surface 64 is spaced axially above upper mating surface 28, forming adapter gap 48. Because of adapter gap 48, bottom surface 64 does not contact upper mating surface 28 and load cells 68 will support the entire load of casing head 16.

When casing head 16 is landed on upper load surface 50, the weight or load of casing head 16 will be supported by the load cells 68 and each load cell 68 will be constrained between upper ring 46 and stem head adapter plate 26. As casing head 16 is landed on upper load surface 50, the load of casing head 16 on load cells 68 could compress load cells 68. This will cause upper ring 46 to move axially downward relative to stem head adapter plate 26. In the example embodiments shown, upper ring 46 can move axially downward along connector members 58 so that connector members are not restraining axial movement of upper ring 46 and load cells 68 can obtain an accurate measurement of the total load by casing head 16.

The number of recesses 62, load cells 68, and piston assemblies 72 will depend on the size of the stem head adapter assembly 24 and the expected load applied by casing head 16 to stem head adapter assembly 24. Embodiments of this disclosure with three load cells 68 and six piston assemblies 72, may, for example, support in the range of up to one million lbs. of load of casing head 16 on all three load cells 68 combined, on all six piston assemblies 72 combined, or on a combination of load cells 68 and piston assemblies 72.

Turning again to FIG. 5, stem head adapter assembly 24 can further include at least one piston assembly 72. In the example of FIG. 3, two piston assemblies 72 are associated with each load cell 68, with one piston assembly 72 being located on either side of each load cell 68. As is best seen in FIG. 5, the piston assemblies 72 are spaced around upper mating surface 28 and a portion of each piston assembly 72 is located within adapter gap 48. Each piston assembly 72 includes piston housing 74 that is removeably attached to upper ring 46. Piston housing 74 is a generally "L" shaped member with a base portion that extends into adapter gap 48 and a lip portion that extends axially upward from the base portion. The lip portion extends along the outer diameter surface of upper ring 46. Piston housing 74 can be removeably attached to upper ring 46 with removable fastener 76 that extends radially through the lip portion and into upper ring 46. Piston housing 74 includes piston cavity 78. Piston cavity 78 is a recess in a bottom surface of piston housing 74 that opens downwards to face upper mating surface 28.

Piston disk 80 is located within piston cavity 78. Piston disk 80 is a disk shaped member with an outer diameter that sealingly engages and inner diameter of piston cavity 78. A bottom surface of piston disk 80 can rest on upper mating surface 28. Injection port 82 extends through piston housing 74, from an exterior surface of piston housing 74 to piston cavity 78. Port fitting 84 is located at the end of injection port 82 at the exterior surface of piston housing 74.

A pressure media can be injected into port fitting 84, through injection port 82 and into piston cavity 78 on an upper side of piston disk 80. The pressure media can be, for example, hydraulic fluid, pressurized air, or other known working gas or fluid. The injection of pressure media will force piston disk 80 downward, which will cause upper ring 46 to move away from stem head adapter plate 26, in an axially upward direction relative to stem head adapter plate 26. This will increase the axial height of adapter gap 48 and relieve the load of casing head 16 from the load cells 68. In such a condition, the load of casing head 16 will be at least partially supported by piston assemblies 72. The load of casing head 16 on at least one of the load cells 68 can be sufficiently relieved in such a manner to allow and operator to remove and replace the relieved load cell 68. If no pressure media is located in piston cavity 78, or if sufficient pressure media is vented out of injection port 82 from piston cavity 78, piston disk may rest on upper mating surface 28, but piston disk will not provide sufficient force to upper mating surface 28 to allow piston assembly 72 to take any of the load of casing head 16.

Turning to FIG. 3, stem head adapter assembly 24 can also include piston control system 86. Piston control system 86 is in fluid communication with each of the piston assemblies 72 so that piston control system 86 can control the flow of pressure media to each of the piston assemblies 72 on an individual basis, or in combination. Piston control assembly can include a remote or locally situated control interface 88. Communication lines 90 extend to each of the piston assemblies 72. Communication lines 90 can themselves provide the pressure media to each of the piston assemblies 72, or can remotely control pressure media valves 92 that in turn control the delivery of pressure media to each of the piston assemblies 72. Alternately, pressure media valves 92 can be locally controlled and piston assemblies 72 can be manually operated at the location of piston assemblies 72 without the use of piston control system 86.

In an example of operation, with casing head assembly 10 landed in stem head 12 during normal operating conditions, the load of casing head 16 will be fully supported by load cells 68. If an operator desires to remove or replace one or more of the load cells 68, the pressure media can be supplied to a sufficient number of piston assemblies 72 to relieve the load of casing head 16 from the identified load cells 68. As an example, if an operator desired to remove all of the load cells 68, then pressure media can be supplied to all of the piston assemblies 72 so that the upper ring 46 moves axially upward relative to stem head adapter plate 26, while maintaining a central axis of upper ring 46 that is collinear with central axis Ax. Because upper ring 46 is moving upward along central axis Ax, there will be no rotational pinch point that might cause a safety concern.

If instead the operator desires to remove only some of the load cells, the operator has the option of supplying pressure media to all of the piston assemblies 72 to move upper ring 46 axially upward relative to stem head adapter plate 26, while maintaining a central axis that is collinear with central axis Ax. The operator would also, however, have the option of providing pressure media to less than all of the piston assemblies 72, or has the option of providing different amounts of pressure media to each of the piston assemblies 72 so that as upper ring 46 moves axially upward relative to stem head adapter plate 26, the central axis of upper ring 46 will rotate relative to central axis Ax. In this scenario, the operator would need to monitor the operation closely to avoid any un-safe pinch points and adjust the operation of the piston assemblies 72 accordingly.

The operator can provide the pressure media to the piston assemblies 72 with piston control system 86 and can operate the flow of pressure media to the piston assemblies 72 either remotely or locally. Once the load of casing head 16 is relieved from a load cell 68, the load cell 68 is no longer constrained between upper ring 46 and stem head adapter plate 26. The operator can easily remove the load cell 68 and replace it as desired. In order to return the load of casing head 16 to the load cells 68, the pressure media in piston cavities 78 can be vented out of piston cavity 78 through the injection port 82 to return piston assembly 72 to a contracted position (FIG. 5).

If the operator desires to remove or replace one of the piston assemblies 72, the operator can ensure that none of the load of casing head 16 is resting on the piston assembly 72 and can take out removable fasteners 76 and then slide piston assembly 72 out of adapter gap 48. If an operator desires, the casing head assembly 10 can be used during normal operating conditions without any piston assemblies 72 being in place and then the operator can secure piston assemblies 72 to upper ring 46 as desired or needed.

The terms "vertical", "horizontal", "upward", "downward", "above", and "below" and similar spatial relation terminology are used herein only for convenience because elements of the current disclosure may be installed in various relative positions.

The system and method described herein, therefore, are well adapted to carry out the objects and attain the ends and advantages mentioned, as well as others inherent therein. While a presently preferred embodiment of the system and method has been given for purposes of disclosure, numerous changes exist in the details of procedures for accomplishing the desired results. These and other similar modifications will readily suggest themselves to those skilled in the art, and are intended to be encompassed within the spirit of the system and method disclosed herein and the scope of the appended claims.

What is claimed is:

1. A casing head assembly for landing on a stem head of a floating structure, the casing head assembly comprising:

a stem head adapter assembly comprising:

a stem head adapter plate, the stem head adapter plate being ring shaped;

an upper ring spaced axially above the stem head adapter plate defining an adapter gap between the upper ring and the stem head adapter plate, the upper ring being a solid ring shaped member;

at least one load cell with a first end that is supported by the stem head adapter plate and a second end that engages the upper ring; and at least one piston assembly selectively secured to the upper ring, wherein the at least one piston assembly includes a removable piston housing having a piston cavity and a piston disk located within the piston cavity;

a casing head landed on, and secured to, the upper ring of the stem head adapter assembly; and wherein the at least one load cell is selectively constrained between the upper ring and the stem head adapter plate by a load of the casing head.

2. The casing head assembly according to claim 1, wherein the stem head adapter plate has an upper mating surface and an opposite facing lower mating surface and the first end of the at least one load cell is supported by the upper mating surface of the stem head adapter plate.

3. The casing head assembly according to claim 1, wherein the stem head adapter plate has an upper mating surface and an opposite facing lower mating surface and the lower mating surface selectively engages the stem head.

4. The casing head assembly according to claim 1, wherein the upper ring is secured to the stem head adapter plate with connector members that allow relative axial movement between the upper ring and the stem head adapter plate and prevent relative rotational movement between the upper ring and the stem head adapter plate.

5. The casing head assembly according to claim 1, wherein the at least one load cell comprises a plurality of load cells spaced around a circumference of the stem head adapter plate.

6. The casing head assembly according to claim 5, wherein the at least one piston assembly comprises two piston assemblies associated with each of the load cells.

7. The casing head assembly according to claim 1, further comprising an injection port in the removable piston housing, and wherein selectively injecting a pressure media through the injection port moves the upper ring axially away from the stem head adapter plate, relieving the load of the casing head from the at least one load cell.

8. The casing head assembly according to claim 1, wherein the removable piston housing is releasably secured to the upper ring with a removable fastener.

9. The casing head assembly according to claim 1, wherein the upper ring includes a plurality of recesses spaced around an outer diameter surface of the upper ring and wherein the at least one load cell comprises load cells located in each of the recesses.

10. A casing head assembly for landing on a stem head of a floating structure, the casing head assembly comprising:

a stem head adapter assembly comprising:

a stem head adapter plate, the stem head adapter plate being ring shaped and having an upward facing upper mating surface and an opposite facing lower mating surface;

an upper ring spaced axially above the stem head adapter plate, defining an adapter gap between the upper mating surface and the upper ring, the upper ring being a ring shaped solid member; and a plurality of load cells, each of the load cells having a first end that is supported by the upper mating surface and a second end that engages the upper ring;

a casing head landed on, and secured to, the upper ring of the stem head adapter assembly; wherein the lower mating surface is selectively landed on, and secured to, the stem head; and wherein the stem head adapter assembly further comprises a plurality of piston assemblies spaced around the upper mating surface with a portion of each of the piston assemblies being located in the adapter gap, and wherein selectively operating the piston assemblies moves the upper ring upward from the stem head adapter plate to enable the load cells to be removed for repair or replacement.

11. The casing head assembly according to claim 10, wherein each of the piston assemblies includes:

a removable piston housing having a piston cavity;

a piston disk located within the piston cavity; and an injection port in the removable piston housing, and wherein selectively injecting a pressure media through the injection port moves the upper ring axially away from the stem head adapter plate.

12. The casing head assembly according to claim 10, further comprising a piston control system, the piston control system being in fluid communication with each of the piston assemblies.

13. The casing head assembly according to claim 10, wherein each of the piston assemblies is releasably secured to the upper ring with a removable fastener.

14. The casing head assembly according to claim 10, wherein the upper ring includes a plurality of recesses, each of the recesses having a downward facing lower load surface and wherein the second end of each of the load cells engages a lower load surface.

15. The casing head assembly according to claim 10, wherein the upper ring includes an upward facing upper load surface and the casing head engages the upper load surface.

16. A method for supporting a casing head assembly on a stem head of a floating structure, the method comprising:

providing a stem head adapter assembly including a stem head adapter plate, a solid ring shaped upper ring spaced axially above the stem head adapter plate defining an adapter gap between the upper ring and the stem head adapter plate, a plurality of load cells with a first end that is supported by the stem head adapter plate and a second end that engages the upper ring, and a plurality of piston assemblies selectively secured to the upper ring;

landing a casing head on the upper ring of the stem head adapter assembly;

landing the stem head adapter plate on an upper end of the stem head; and supporting and measuring a load of the casing head with the load cells.

17. The method according to claim 16, further comprising operating at least one of the plurality of piston assemblies to lift the upper ring relative to the stem head adapter plate, then removing and replacing at least one of the plurality of load cells, and then returning the at least one of the plurality of load cells to a contracted position.

18. The method according to claim 17, wherein the stem head adapter assembly further comprises a piston control system in fluid communication with each of the piston assemblies and wherein the step of operating at least one of the plurality of piston assemblies includes controlling each of the plurality of load cells individually or in combination with the piston control system.

19. The method according to claim 17, wherein the step of operating at least one of the plurality of piston assemblies includes operating one or more of the plurality of piston assemblies manually and locally.

* * * * *